US005081921A

United States Patent [19]

Gregoire

[11] Patent Number: 5,081,921

[45] Date of Patent: Jan. 21, 1992

[54] PNEUMATIC PRESS

[75] Inventor: James Gregoire, Cognac, France

[73] Assignee: Etablissements Gregoire S.A., France

[21] Appl. No.: 534,817

[22] Filed: Jun. 7, 1990

Related U.S. Application Data

[62] Division of Ser. No. 335,709, Apr. 10, 1989, abandoned.

[30] Foreign Application Priority Data

Apr. 11, 1988 [FR] France ..... 88 04761

[51] Int. Cl.[5] ..... B30B 9/02; B30B 5/02; B30B 9/22

[52] U.S. Cl. ..... 100/37; 100/110; 100/127; 100/131; 100/211

[58] Field of Search ..... 99/495; 100/37, 110, 100/112, 116, 126-129, 131, 211

[56] References Cited

U.S. PATENT DOCUMENTS

| | | | |
|---|---|---|---|
| 4,438,690 | 3/1984 | von Allworden | 100/116 |
| 4,513,659 | 4/1985 | Braun | 100/211 X |
| 4,651,637 | 3/1987 | Steinke | 100/127 X |
| 4,872,404 | 10/1989 | Quetsch et al. | 100/110 X |

FOREIGN PATENT DOCUMENTS

| | | | |
|---|---|---|---|
| 3224087 | 12/1983 | Fed. Rep. of Germany | 100/211 |
| 3312733 | 10/1984 | Fed. Rep. of Germany | 100/116 |
| 3440558 | 5/1988 | Fed. Rep. of Germany | 99/495 |

*Primary Examiner*—Philip R. Coe
*Assistant Examiner*—Stephen F. Gerrity
*Attorney, Agent, or Firm*—Krass & Young

[57] ABSTRACT

The invention relates to a method of pressing fruit, in particular grapes, in a rotary cylindrical drum containing at least one flexible membrane supplied with a fluid under pressure in order to press fruit against the wall of the drum, and also to a pneumatic press for implementing the method. The pneumatic press of the invention is of the type comprising a rotary cylindrical drum (7) containing at least one flexible membrane (9, 35) and is characterized by the fact that said drum (7) is closed at one end (7), with a loading duct (19) opening out into the drum (7) in the vicinity of its closed end, the end of the drum opposite to its closed end (7) being at least partially open, said drum (7) including means (16) for recovering juice. The invention is particularly applicable to pressing grapes.

13 Claims, 3 Drawing Sheets

PNEUMATIC PRESS

This is a divisional of copending application Ser. No. 07/335,709 filed on Apr. 10, 1989, (now abandoned).

The invention relates to a method of pressing fruit, and to a pneumatic press of the type comprising a rotary cylindrical drum containing at least one flexible membrane and suitable for implementing the method.

BACKGROUND OF THE INVENTION

There has been considerable development in pneumatic presses because of the high quality of the juice that they are capable of obtaining, in particular from grape, most by virtue of the juice being extracted gently due to the low pressures of about 2 bars that are exerted.

However, they suffer from considerably drawbacks which have limited their spread. The main drawback of prior art pneumatic presses lies in their discontinuous operation. These prior art pneumatic presses have a fruit loading hatch which is also used for removing residue, in particular grape marc. The operating cycle of these prior art machines thus comprises a loading stage during which the drum is stationary, optionally preceded by a stage during which a vacuum is applied to its membrane, followed by a juice extraction stage during which the membranes are progressively inflated while the drum is rotated, and a residue unloading stage during which the drum is again at rest.

The loading and unloading stages occupy a relatively large fraction of the total cycle time and, above all, the fruit is stored prior to being brought to the press and this can give rise to rapid oxidizing of the fruit, particularly if the fruit has been harvested mechanically, and such oxidizing reduces the quality of the resulting juice.

Further, most prior art pneumatic presses are ill-adapted to selecting juice as a function of the pressure at which it was obtained. Such selection requires the machine to be stopped prior to increasing the pressure and changing the juice-collecting tank.

Proposals have also been made to use a non-perforated drum fitted with juice flow ducts for selecting juices more easily. However, such machines also operate discontinuously and, in addition, such flow ducts are difficult to provide.

The present invention seeks to mitigate these drawbacks of prior pneumatic presses by providing a novel press which is particularly well adapted to semi-continuous or permanent operation enabling fruit, and in particular grapes, to be loaded on a permanent basis and also making it easy to select juice as a function of the pressure at which it was extracted. In all embodiments of the invention, waste evacuation is facilitated by using a large evacuation opening.

SUMMARY OF THE INVENTION

To this end, the invention provides a method of pressing fruit, in particular grapes, in a rotary cylindrical drum, containing at least one flexible membrane fed with pressure to press the fruit against the wall of the drum, the method being characterized by the fact that the fruit to be pressed is admitted into the cylindrical drum in the vicinity of a closed end thereof, the juice expelled by inflation of said membrane is recovered, and the waste is evacuated via an opening at the opposite end of said drum.

The press for implementing the method of the invention is characterized by the fact that said drum is closed at one end, a loading duct opens out into the vicinity of its closed end of the drum, and the end of the drum opposite to its closed end is at least partially open, said drum including juice recovery means.

The fruit to be pressed is admitted into the drum via the loading duct which opens out into the drum. Waste, such as marc, is evacuated via the open end of the drum, thereby making it possible to use an opening which is larger in size than the conventional hatch which is also used for loading the fruit. The duration of a pressing cycle is thus greatly reduced.

In one embodiment of the invention, the drum includes a member for evacuating waste, e.g. an endless screw. In a variant, or in addition, the drum is tiltable, e.g. by means of jacks.

In a preferred embodiment, said drum contains axial transport means for transporting the mass to be pressed, and it includes a plurality of radial partitions constituting a plurality of adjacent axial chambers each of which is closed in the radial direction by a flexible membrane, each of said chambers being connected to an individual source of pressure or vacuum, a fruit admission duct opening out into the closed end of the drum or in the vicinity thereof.

By virtue of using internal means for displacing the mass to be pressed parallel to the axis of the drum, a press of the invention can operate semi-continuously or permanently, i.e. during stages in which the displacement means is stopped, fruit can be pressed at different pressures in the different zones in which the fruit is to be found. The press can simultaneously be loaded. During periods when the displacement means is operating, the fruit material advances from one zone to the next, and simultaneously residue is evacuated.

In an embodiment of the invention, said displacement means is constituted by an endless screw whose radial extent is slightly less than the inside radius of the drum, with the drum rotating about a rotary shaft to which said radial partitions are fixed.

The fruit to be pressed is admitted into the drum via an admission duct which opens out into a first or pre-chamber of the drum which does not include a closed chamber. By rotating the screw, the fruit is advanced into a first active compartment situated around the first of the closed chambers, and after the screw has been stopped, inflating the corresponding chamber presses the fruit against the adjacent wall of the drum. While the screw is stationary, a new load of fruit can be admitted into the pre-chamber. Next time the screw is rotated, the first load is advanced to the second active compartment in the second chamber while the second load is advanced into the first compartment. The screw is then stopped again, the first and second chambers are both pressurized, with the second chamber being subjected to a higher pressure than the first, and a third load is admitted. The pressing process continues progressively in this way through successive active compartments and residue is automatically evacuated via the open end of the drum.

In an embodiment of the invention, the inlet duct is connected to a pump via a rotary joint.

Preferably, the drum is perforated and the means for recovering juice comprises a recovery basin disposed beneath the drum and including walls dividing it axially into a plurality of partial basins each having its own outlet for selecting juice. In order to obtain finer selection, a variant of the invention provides for at least one of said walls being surmounted by an adjustable draining board.

The endless screw may be an Archimedes screw fixed to said rotary shaft. In a variant, the endless screw is constituted by a spiral fixed to the rotary drum or to the rotary shaft. In another variant, the endless screw is a screw including non-helical rectilinear portions, the membranes being fixed in cells formed by the rectilinear portions which simultaneously constitute separation partitions.

The drum and the shaft may be rotated independently from each other by two drive units each including a motor, a gear box and a brake, each drive unit cooperating with a chain engaged on a chain wheel, one of which is fixed to the drum and is coaxial therewith, and the other of which is fixed to the shaft. Preferably, the speed and/or the direction of rotation of the drum and/or the screw are variable.

In a particularly advantageous variant, said rotary drum is perforated over one half of its periphery, with the end of the perforated half opposite to the closed end of the drum being open, and with the non-perforated half of the drum being closed at its end opposite to the closed end of the drum, said non-perforated half carrying said radial partitions, each of which constitutes a circular half-sector, said partitions being uniformly spaced, the perforated half of the drum containing a plurality of circular half-sector walls at the same spacing as the partitions, said walls being fixed to each other and being movable in axial translation between a working position in which the last wall furthest from the closed end of the drum closes the open end of the perforated half of the drum, and an end-of-transport position in which said walls are moved away from the closed end of the drum by an amount equal to the common spacing between the partitions and the walls.

The pressing work, and optionally the breaking up work, takes place with the walls in the working position, while the fruit is transported from one compartment to the axially following compartment during translation of the walls up to their end-of-transport position, and simultaneously the residue contained in the last axial compartment is evacuated via the open end of the perforated half of the drum. This also provides semi-continuous or permanent operation in which pressing cycles alternate with cycles during which the substance to be pressed is transported and waste is evacuated.

BRIEF DESCRIPTION OF THE DRAWINGS

Embodiments of the invention are described by way of example with reference to the accompanying drawings, in which.

DETAILED DESCRIPTION

Figure 1:
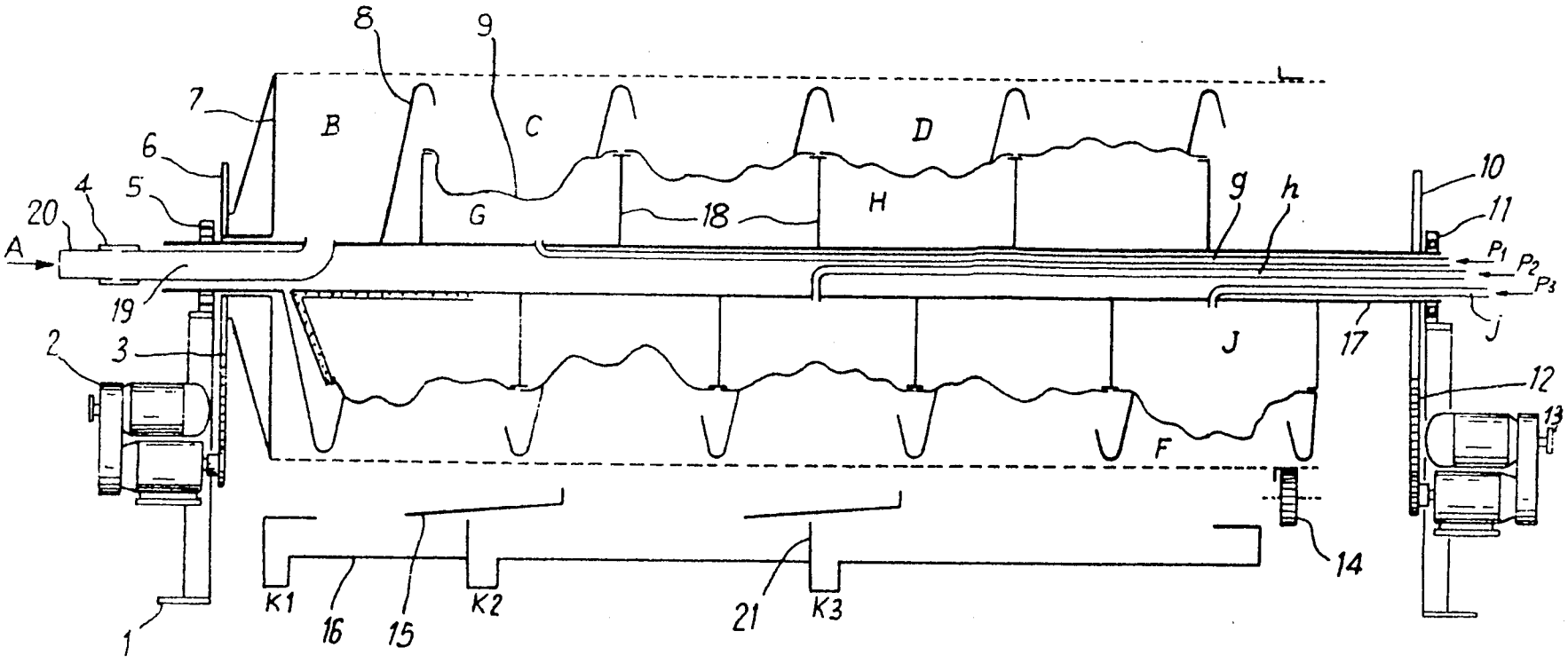
FIG. 1 is a diagrammatic elevation view of a first embodiment of a press in accordance with the invention, with the drum being shown as though it were transparent.

Reference is made initially to FIG. 1 which is a diagram of a pneumatic press constituting a first embodiment of the invention.

The press comprises a perforated cylindrical drum 7 made of stainless steel and sometimes referred to as the "draining tank". The drum 7 is closed at its inlet end (to the left in the figure) and open at its opposite or outlet end. The drum 7 is mounted to rotate on a frame 1 and it is rotated in one direction or the other at adjustable speed by a drive unit 2 including a motor, a gear box, and a brake, with the drive unit driving a chain 3 engaged on a chain wheel 6 fixed to the drum 5 and coaxial therewith. The end of the drum 7 opposite to the chain wheel 6 is guided by wheels 14.

A hollow shaft 17 is mounted coaxially inside the drum 7 and is rotated in one direction or the other at variable speed by a drive unit 13 driving a chain 12 engaged on a chain wheel 10 fixed to the shaft 17. The shaft 17 is mounted on the frame 1 via ball bearings 5 and 11.

The hollow shaft 17 carries an Archimedes screw 8 whose diameter is slightly less than the diameter of the drum 7. Membranes 9 are fixed substantially half-way out along the turns of the screw 8 and they are separated by air-tight partitions 18 thus constituting axial chambers G, H, and J. Each of these chambers can be connected to a source of compressed air or to a vacuum pump via a respective pipe g, h, and j running along the inside of the shaft 17.

Zones C, D, and F are provided between the membranes 9 and the inside peripheral surface of the drum 7. At the inlet to the drum 7 adjacent to its closed end, there are no membranes, and the first partition 18 is at a distance from this end. The zone B provided in this way is connected to the outside by a pipe 19 mounted inside the hollow shaft 17 and passing through the wall thereof. The pipe 19 is connected to a fruit feed 20, in particular for feeding grapes, via a rotary seal 4.

A juice collecting basin 16 is disposed beneath the drum 7 and occupies substantially the entire length of the drum.

The press operates as follows.

Fruit urged forwards by a pump (not shown) enters the pipe 19 in the direction of arrow A. The fruit then enters the pre-chamber B which is not fitted with a membrane. The drum 7 may be rotating or stationary during loading, but the shaft 17 and the screw 8 thereon are stationary.

After the shaft 17 and the screw 8 have been set in motion, the fruit is urged towards the zone C. The screw 8 is stopped once the zone C is full and the membrane 9 is put under pressure via the pipe g. The membranes 9 in the zones H and J are also put under pressure in order to press fruit which has arrived in the zones D and F during earlier rotations. The pressure exerted by the membranes 9 on the fruit presses the fruit against the inside wall of the perforated drum, and causes the juice therein to be extracted and to pass through the drum 7 to be collected in the basin 16.

In order to extract juice more quickly, each pressing stage may be followed by a breaking-up stage. The membranes 9 are deflated by connecting the chambers G–J to a vacuum pump or simply to atmospheric air. The drum 7 and the screw 8 are rotated in opposite directions and at equal speed. The fruit is consequently crushed and broken up.

The residue, i.e. marc when using grapes, is dried during the various pressing and breaking up cycles to which it is subjected and it is automatically evacuated via the open end of the drum 7 during each rotation cycle of the screw 8. The press thus operates permanently, alternating between extraction stages (pressing or breaking up) and displacement stages, with fruit being admitted and residue being evacuated during the displacement stages.

The speed of the screw 8 may be less than or greater than the speed of the drum 7, thereby making it possible to displace fruit in one axial direction or the other.

The number of alternating pressing and breaking up stages may be increased depending on the desired drying rate. The pressures applied while pressing increase from chamber G to chamber J, and generally lie in the range 0.2 bars for chamber G to 2 or more bars for chamber J.

For example, the following pressures may be chosen:

$P_1$ (chamber G)=0.2 bars $P_2$ (chamber H)=1 bar $P_3$ (chamber J)=2 bars.

These pressures may also vary during a pressing stage.

Since the screw 8 and the drum 7 are driven independently in either direction and at variable speed, numerous operating combinations are possible. The number of zones may also be changed.

In order to select juice as a function of the zone in which it was extracted, the basin 16 may be provided with walls 21 so as to constitute partial basins each provided with its own outlet $K_1$, $K_2$, and $K_3$. In order to further refine juice selection, adjustable draining boards 15 are disposed above the walls 20.

The frame 1 may be fixed on jacks in order to enable the press to be inclined in one direction or the other at a predetermined angle so as to accelerate or slow down residue exit.

Figure 2:
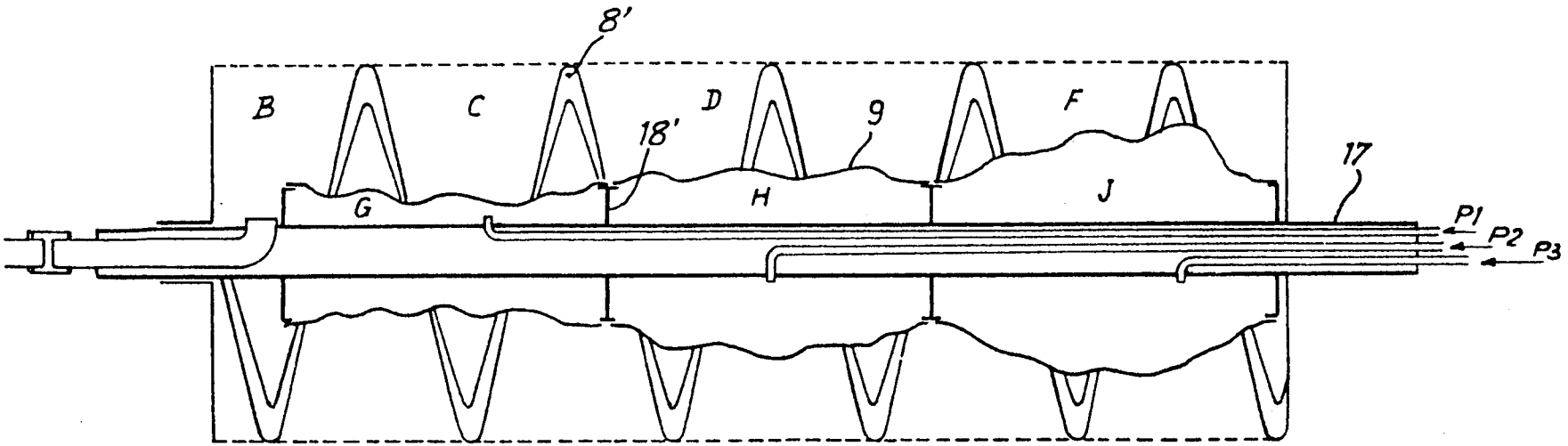
FIG. 2 is analogous to FIG. 1, but shows a different embodiment.

In the embodiment shown in FIG. 2, the screw is formed by a single spiral 8' which may be fixed to the hollow shaft 17 or to the drum 7. The partitions 18' support membranes 9 as in the example of FIG. 1. This press operates identically to the previous example.

In an embodiment which is not shown, the screw 8' may alternatively include non-helical rectilinear portions producing an effect identical to that of an Archimedes screw. These rectilinear portions are also used for membrane fixing and they act in the same way as the above partitions 18'.

The fruit may be fed directly into a feed hopper of the feed pump.

Figure 3:
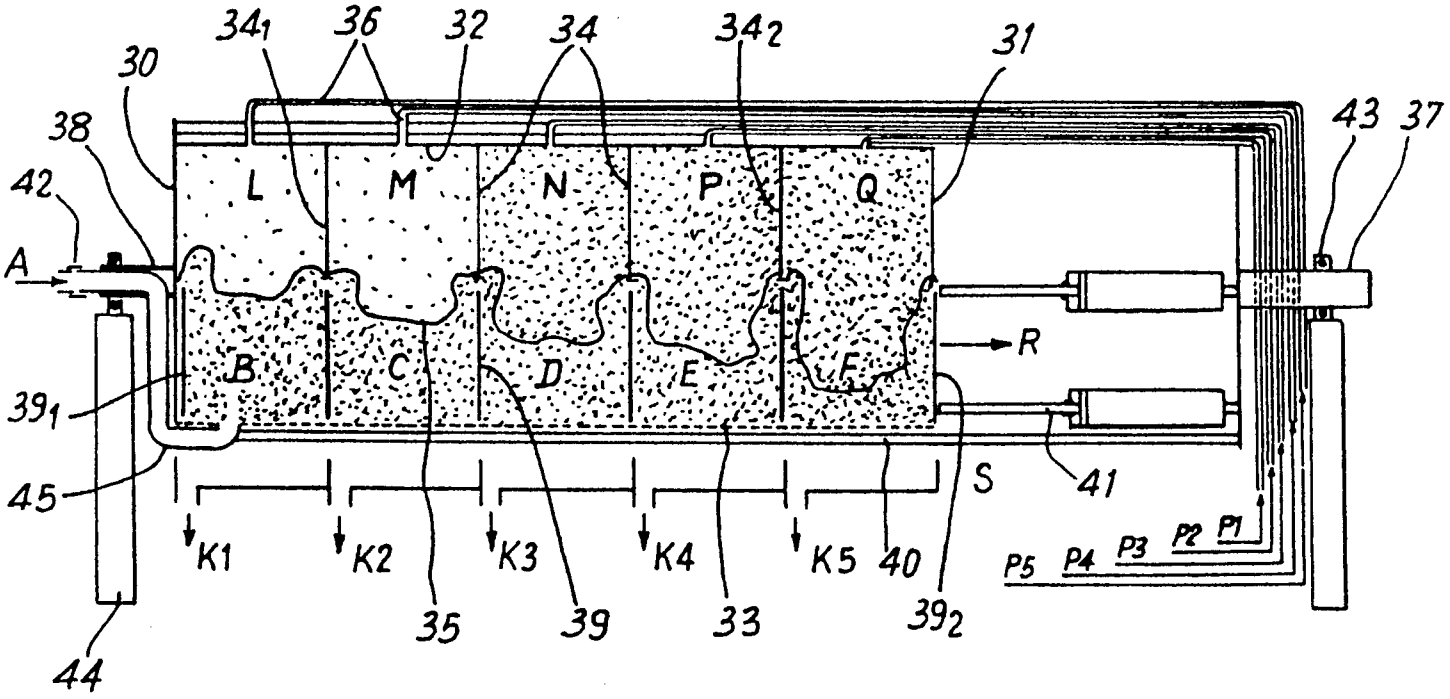
FIG. 3 is analogous to FIGS. 1 and 2 and shows yet another embodiment.

Reference is now made to FIG. 3 which shows another embodiment of the press in accordance with the invention.

The draining tank is constituted by a stainless steel cylinder having one end 30 which is closed and having its other end which is half closed over half a circumference 31. The half-periphery 32 of the drum adjacent to the half-circumference 31 is solid, i.e. not perforated, whereas the half-periphery 33 is perforated.

Air-tight partitions 34 in the form of circular half-sectors are fixed to the solid portion 32 of the drum at constant spacing, with the first partition $34_1$ being at the same spacing from the closed end 30 and with the last partition $34_2$ being at the same spacing from the half-circumference 31. Together with the ends 30 and 31, the partitions 34 determine cells L, M, N, P, and Q between one another, each of which cells is closed by a flexible membrane 35 of air-tight cloth. The cells L–Q can be fed selectively with compressed air or vacuum via tubes 36 passing through a rotary joint 37 fixed to the shaft 38 of the cylinder.

When the membranes 35 are inflated, they cover respective opposite portions of the perforated half-cylinder 33, whereas when they are subjected to vacuum, they cover the bottoms of their respective cells L–Q.

Semi-circular walls 39 are disposed opposite the partitions 34 and in the pressing position shown in FIG. 3, a first wall $39_1$ is adjacent to the closed end 30 of the cylinder and a last wall $39_2$ closes the end opening of the perforated half-cylinder 33.

The walls 34 are mechanically interconnected by rods 40 and may be displaced together in translation to the right (in the drawing) through a distance equal to the common spacing between the partitions 34 and the walls 39 by means of actuators 41 which are powered via the rotary joint 37. The walls 39 are constrained to rotate with the cylinder.

Compartments B, C, D, E, and F are delimited between the walls 39. Fruit admission A takes place via a rotary joint 42 connected to a tube 45 opening out into the first compartment B. The cylinder is rotatably mounted on bearings 43 mounted on a frame 44 and is driven by a drive unit (not shown).

Operation is as follows. At the beginning of a cycle, the cylinder is empty and the walls 39 are in the position shown in FIG. 1. The membranes 35 are sucked against the bottoms of their respective cells by the vacuum.

The compartment B and the volume of the cell L are filled via the tube 45. The first membrane 35 is then put under pressure and the fruit is compressed against the perforated wall 33 of the cylinder, which wall then constitutes its bottom wall. The extracted juice is collected, as before, in a basin $K_1$. The membranes 35 are then evacuated again and the walls 34 are then displaced to the right by means of the actuators 41 through a distance equal to their spacing. The partially pressed fruit passes from compartment B to compartment C.

The cylinder may then be rotated several times in order to break up the already-pressed fruit and the cylinder is stopped at an angular position such that its perforated portion 33 and the walls 39 are on top. The actuator 41 then returns the walls 39 to their initial axial position and the fruit is contained in the bottom of cell M. The cylinder is then rotated through 180° and compartment B and cell L are refilled. By continuing to process in this manner, the compartments B–F will contain fruit that has been pressed to a greater and greater extent. During the next cycle, the waste contained in compartment F is evacuated through the end opening of the perforated half cylinder 33.

The compartment B and the cell L can be loaded while the compartment C–F are under pressure, after which a small amount of pressure can be applied to compartment B. Thereafter all of the membranes 35 are withdrawn and breaking up is performed without reloading, after which the walls 39 are moved in translation as described above.

As in the preceding embodiments, different pressures are applied to the membranes 35 and these pressures may be obtained using air, some other compressed gas, or a liquid such as water.

In an extremely simple embodiment (not shown), the cylinder of FIG. 1 does not have partitions 34 or walls 39 and contains only one membrane 35. The end wall 39 is replaced by an access hatch. In order to facilitate extracting waste, a device such as an endless screw may be provided or else the cylinder may be tilted. This embodiment of the invention makes it possible to extract residue more quickly than is possible using conventional presses.

The present invention has been described with reference to various particular embodiments, but it is not limited thereto. Numerous modifications are possible without going beyond the scope of the invention, for example, it is possible to remove the juice via drainage channels, with the wall of the drum then being solid. Means other than those described may be provided for moving the mass to be pressed.

I claim:

1. A method of operation of a rotating drum pneumatic press, the method comprising the steps of:

loading a quantity of mass to be pressed through a loading duct into a first pressing compartment adjacent a closed end of said drum;

pressurizing an axial pressure cell radially opposite said first pressing compartment to press a membrane against said mass to be pressed in the direction of a perforated sidewall portion of said drum;

evacuating said pressure cell;

axially translating said first pressing compartment in the direction of an open end of the drum with actuator means to move said mass to be pressed axially along the drum to a position opposite a second axial pressure cell;

rotating said drum such that the radial positions of said first pressing compartment and said axial pressure cells are reversed;

axially translating said first pressing compartment back in the direction of the closed end of the drum to align it with said first axial pressure cell; and rotating said drum to return said first pressing compartment and said axial pressure cells to their original radial positions, such that said quantity of mass to be pressed is transferred to a second pressing compartment aligned with said second axial pressure cell.

2. A method of operation as defined in claim 1, the method further comprising the steps of:

reloading said first axial pressing compartment adjacent said closed end of said drum with additional mass to be pressed;

pressurizing each of said axial pressure cells radially opposite pressing compartments containing mass to be pressed; and evacuating a portion of said mass to be pressed which has gone through a desired number of pressing steps from the open end of said drum with said actuator means by axially translating said pressing compartments toward the open end of said drum.

3. A pneumatic press comprising:

a rotary cylindrical drum having a sidewall, a closed end and an open end;

means for rotating said drum;

a loading duct formed in said drum adjacent said closed end for loading into said drum a mass to be pressed;

axial transport means mounted in said drum for transporting the mass to be pressed from said closed end to said open end;

at least one radial partition connected to and extending radially inward from a first sidewall portion of the drum;

a flexible membrane connected to said radial partition and the ends of the drum;

at least two axial pressure cells defined by said membrane, said radial partition, the ends of the drum and the first sidewall portion of the drum, each of said pressure cells connected to a separate source of pressure for selectively and independently extending the membrane corresponding to each pressure cell away from the first sidewall portion of the drum toward a second sidewall portion of the drum radially opposite the first sidewall portion to exert pressure on the mass to be pressed; wherein, the second sidewall portion of the drum is perforated to permit the flow of liquid from the mass to be pressed out of the drum when pressure is exerted thereon by the membrane.

4. Apparatus as defined in claim 3, wherein said first and second sidewall portions of the drum comprise half-cylinder portions.

5. A pneumatic press as defined in claim 3, wherein said at least one radial partition is substantially semicircular.

6. Apparatus as defined in claim 3, wherein said axial transport means are located in said drum adjacent said second perforated sidewall portion.

7. A pneumatic press comprising:

a rotary cylindrical drum having a sidewall, a closed end and an open end;

means for rotating said drum;

a loading duct formed in said drum adjacent said closed end for loading into said drum a mass to be pressed;

axial transport means mounted in said drum for transporting the mass to be pressed from said closed end to said open end;

at least one radial partition connected to and extending radially inward from a first sidewall portion of the drum;

a flexible membrane connected to said radial partition and the ends of the drum;

at least two axial pressure cells, each pressure cell defined by said membrane, said radial partition, the ends of the drum and the first sidewall portion of the drum, each of said pressure cells connected to a source of pressure for selectively and independently extending the membrane corresponding to each pressure cell away from the first sidewall portion toward a second sidewall portion radially opposite the first sidewall portion to exert pressure on the mass to be pressed; wherein, the second sidewall portion of the drum is perforated to permit the flow of liquid from the mass to be pressed out of the drum when pressure is exerted thereon by the membrane;

said axial transport means are located in said drum adjacent said second perforated sidewall portion;

said axial transport means comprise at least two wall portions extending radially from and mounted movably with respect to said second perforated sidewall portion, said wall portions dividing said second sidewall portion of the drum into at least two pressing compartments corresponding to said pressure cells, said wall portions further having actuator means connected thereto for axially translating said wall portions in the direction of said open end of said drum a distance at least equal to the axial length of one of said axial pressure cells.

8. A pneumatic press as defined in claim 7, wherein said wall portions are mechanically interconnected for simultaneous axial displacement by said actuator means.

9. A pneumatic press of the type comprising a rotary cylindrical drum having a first sidewall portion and a second perforated sidewall portion, a closed end and an open end, and a loading duct formed in said drum adjacent the closed end of the drum for loading into the drum a mass to be pressed, wherein said drum further comprises:

a plurality of radial partitions extending inwardly from the first sidewall portion of said drum defining a plurality of axial pressure cells closed in the radial direction by a flexible membrane connected to said radial partitions and the ends of the drum;

a source of pressure connected to each of said axial pressure cells to selectively and independently extend the flexible membrane of each axial pressure cell toward the second perforated sidewall portion of the drum;

the open end of said drum including a closed portion contiguous with the first sidewall portion of the drum;

axial transport means for transporting the mass to be pressed along the length of the drum, said axial transport means located in said drum adjacent said second perforated sidewall portion and comprising a plurality of interconnected wall portions extending radially inwardly from the second perforated sidewall portion opposite said radial partitions and axially spaced corresponding essentially to the axial spacing of said radial partitions; wherein, said axial transport means are mounted for rotation with said second perforated sidewall portion of said drum and are axially translatable between a rest position in which the wall portion furthest from the closed end of the drum is spaced from the open end of the drum, and a working position in which the open end of said drum is essentially closed by the wall portion furthest from the closed end of the drum.

10. Apparatus as defined in claim 9, wherein the distance traveled by said axial transport means between said rest and working positions essentially corresponds to the axial distance between said radial partitions.

11. A pneumatic press comprising:

a rotary cylindrical drum having a first solid sidewall portion, a second perforated sidewall portion, a closed axial end and an open axial end;

a plurality of pressure cells spaced axially along said first solid sidewall portion, said pressure cells radially closed by a flexible membrane;

axial transport means in said drum defining a plurality of pressing compartments spaced axially along said second perforated sidewall portion, the pressing compartments movable axially along the length of the drum relative to said pressure cells by said axial transport means;

means for loading a mass to be pressed into a first of said pressing compartments adjacent said closed end of the drum;

means for selectively pressurizing and evacuating said pressure cells to selectively extend and retract the flexible membrane of each pressure cell toward and away from said second perforated sidewall portion to exert pressure on the mass to be pressed contained in said pressing compartments; and means for selectively rotating said drum and activating said axial transport means to axially displace material to be pressed from a first pressing compartment adjacent the closed axial end of the drum through successive pressing compartments and out the open axial end of the drum.

12. Apparatus as defined in claim 11, further including means for selectively and independently pressurizing each of said pressure cells to exert a stepwise progressive pressurization on the material to be pressed as it is displaced through successive pressing compartments.

13. A pneumatic press comprising:

a substantially horizontally arranged rotary cylindrical drum having first and second essentially half-cylindrical sidewall portions and a closed and an open axial end; said second half-cylindrical sidewall portion comprising perforations for draining liquid;

means for rotating said drum;

a duct for charging into said drum a mass to be pressed, said duct entering said drum at a location adjacent to said closed end;

axial transport means, mounted in said drum for transporting said mass to be pressed within said drum in an axial direction;

said drum comprising in its interior at least one radial partition extending from said first half-cylindrical sidewall portion and separating at least two pressure cells of said drum;

a flexible membrane for each pressure cell connected to said radial partition;

said pressure cells being arranged axially adjacent to each other and being defined in part by said partition, said membrane and said first half-cylindrical sidewall portion of the drum;

each of said pressure cells connected to a separate source of pressure, each of said sources of pressure being capable of providing different pressure in each pressing cell;

at least two pressing compartments adjacent to said perforated second half-cylindrical wall portion of said drum, wherein;

the mass to be pressed is loaded into a first of said pressing compartments adjacent said closed axial end whereby pressurizing of said pressure cells by means of activation of said pressure sources results in an inflation of said membranes such that the mass to be pressed within said pressing compartments is compressed and a liquid is extracted from said mass, which liquid leaves said pressing compartments through said perforated second half-cylindrical wall portion of said drum;

whereby intermittent axial transportation of said mass from one pressing compartment to the next permits a subsequent stepwise progressive pressurization of said mass;

said pneumatic press further comprising collection means for said liquid, which collection means is subdivided into at least two sections capable of separately collecting liquid pressed out of separate pressing compartments.

* * * * *